United States Patent [19]

Chromecek et al.

[11] Patent Number: 5,017,238

[45] Date of Patent: May 21, 1991

[54] AQUEOUS CLEANING DISPERSIONS USING ADSORPTIVE POLYMERIC POWDER AND METHOD OF USING

[75] Inventors: Richard C. Chromecek, Litchfield County, Conn.; Milan F. Sojka, Orange County, N.Y.

[73] Assignee: Dow Corning Corporation, Midland, Mich.

[21] Appl. No.: 400,832

[22] Filed: Aug. 30, 1989

[51] Int. Cl.[5] ..... B08B 3/04; B08B 3/08

[52] U.S. Cl. ..... 134/7; 134/26; 134/42; 252/106; 252/174.23; 252/DIG. 2; 526/318; 526/320; 526/323.1

[58] Field of Search ..... 526/323.1, 320, 318; 134/7, 26, 42; 252/106, 174.23, DIG. 2

[56] References Cited

U.S. PATENT DOCUMENTS

| | | | |
|---|---|---|---|
| Re. 27,026 | 1/1971 | Alfrey, Jr. et al. . | |
| 2,809,943 | 10/1957 | Pye et al. . | |
| 3,418,262 | 12/1968 | Werotte et al. . | |
| 3,509,078 | 4/1970 | Roubiuck et al. . | |
| 3,518,341 | 6/1970 | Haryu | 264/255 |
| 3,583,957 | 6/1971 | Chromecek et al. . | |
| 3,627,708 | 12/1971 | Morne et al. . | |
| 3,637,535 | 1/1972 | Corte et al. . | |
| 3,767,600 | 10/1973 | Albright . | |
| 3,989,649 | 11/1976 | Kaiho et al. . | |
| 4,011,388 | 3/1977 | Murphy et al. | 526/320 |
| 4,026,826 | 5/1977 | Yoshida et al. | 525/479 |
| 4,046,706 | 9/1977 | Krezanoski | 134/40 |
| 4,208,309 | 1/1980 | Kraemer et al. . | |
| 4,224,415 | 9/1980 | Meitzner et al. . | |
| 4,259,462 | 3/1981 | Nakano et al. | 526/320 |
| 4,655,957 | 4/1987 | Chromecek et al. | 252/174.23 |
| 4,661,327 | 4/1987 | Horton . | |
| 4,690,825 | 9/1987 | Won . | |
| 4,724,240 | 2/1988 | Abrutyn . | |
| 4,806,360 | 2/1989 | Leong et al. . | |
| 4,962,170 | 10/1990 | Chromecek et al. | 526/212 |

FOREIGN PATENT DOCUMENTS

| | | | |
|---|---|---|---|
| 1168157 | 5/1984 | Canada | 167/310 |
| 252463 | 1/1988 | European Pat. Off. . | |
| 2608533 | 9/1976 | Fed. Rep. of Germany . | |
| 1164 | 2/1988 | PCT Int'l Appl. . | |

*Primary Examiner*—Theodore Morris
*Assistant Examiner*—Zeinab El-Arini
*Attorney, Agent, or Firm*—John L. Chiatalas

[57] ABSTRACT

An aqueous cleaning dispersion, especially suitable as a contact lens cleaning solution, which includes a homogeneous mixture of water and a liquid-adsorbable powder homopolymer of tetraethylene glycol dimethacrylate.

16 Claims, No Drawings

AQUEOUS CLEANING DISPERSIONS USING ADSORPTIVE POLYMERIC POWDER AND METHOD OF USING

BACKGROUND OF THE INVENTION

This invention relates to aqueous cleaning dispersions, such as contact lens cleaning dispersions, which incorporate adsorptive hydrophilic polymeric powders.

It is known in the art to use adsorptive polymeric powders in aqueous cleaning solutions. Specifically, U.S. Pat. No. 4,655,957 discloses an aqueous suspension for cleaning which includes a particulate hydrophilic cross-linked vinyl-type homopolymer or copolymer selected from the group consisting of poly(hydroxyalkyl methacrylate), poly(hydroxyalkyl acrylate), and poly N-vinyl lactam or mixtures thereof.

SUMMARY OF THE INVENTION

It has been found, however, that an improved polymer particulate can be made which is easier to process into aqueous dispersions and continues to readily adsorb a substantial amount of both hydrophilic and hydrophobic liquids. This new polymer particulate is of a suitably soft nature which is not likely to scratch a delicate surface, such as a contact lens, or irritate the eye if left on a contact lens placed on the eye. It is believed that the cleaning proceeds via polymer adsorption of the protein and lipid deposits found on the contact lens.

In accordance with this invention, there is provided an aqueous cleaning composition which comprises a homogeneous mixture of water and a liquid-adsorbable powder homopolymer of tetraethylene glycol dimethacrylate. Generally, the polymer of tetraethylene glycol dimethacrylate is employed in amount ranging from 0.001 to 25 weight percent of the dispersion, and the dispersion further contains a surfactant employed from 0.1 to 10 weight percent of the dispersion.

The poly(tetraethylene glycol methacrylate) powder can be prepared by (a) homogeneously mixing a solution comprising from 0.1 to 40 parts by weight of tetraethylene glycol dimethacrylate, from 60 to 99.9 parts by weight of a solvent, wherein the total weight of the tetraethylene glycol dimethacrylate and solvent is 100 parts, and 0.05 to 5 weight percent initiator based on the weight of the tetraethylene glycol dimethacrylate, and (b) polymerizing the tetraethylene glycol dimethacrylate to form a polymer, wherein the solvent is a solvent for tetraethylene glycol dimethacrylate and a non-swelling non-solvent for the polymer.

The invention also includes a method for cleaning contact lenses comprising the steps of (a) applying the dispersion described above to a contact lens, (b) rubbing the lens with the dispersion, and, (c) thereafter, rinsing the lens.

DETAILED DESCRIPTION OF PREFERRED EMBODIMENTS OF THE INVENTION

As mentioned, the cleaning dispersion of this invention will typically contain 0.001 to 25 weight percent of the poly(tetraethylene glycol methacrylate) powder in water. The cleaning dispersions may also contain one or more appropriate surfactants, and may contain stabilizers, thickening agents, buffering agents, preservatives, sequestering agents, etc.

Concentrations of surfactants generally range from 0.01 to 10 weight percent. Examples of surfactants useful in the dispersions of this invention include ethylene oxide/propylene oxide surfactants, for example, poloxamers and their block polymers of tetrafunctional initiators such as ethylenediamine, e.g. poloxamine 1107 (TETRONIC 1107 available from BASF Wyandotte Corporation, Parsippany, New Jersey) and ethoxylated lauramide (AMIDOX C5 available from Stepan Chemical Company, Northfield, Illinois), polyethylene glycol esters of fatty acids (e.g. coconut, polysorbate) polyoxyethylene or polyoxypropylene ethers of higher alkanes (C12–C18).

The poly(tetraethylene glycol methacrylate) powder is prepared by precipitation polymerization of tetraethylene glycol dimethacrylate monomer. Precipitation polymerization carried out in a sufficient amount of solvent will result in the soft, adsorbable particles desired. Recently issued U.S. Pat. No. 4,962,170 to Chromecer, et al., entitled "Method of Making Highly Adsorptive Polymers", being filed on the same data herewith, and hereby incorporated by reference, describes methods suitable for making the powder used in this invention.

The polymerization is simply done by dissolving the tetraethyleneglycol dimethacrylate monomer in a solvent which does not swell or dissolve the resulting polymer. Based on the weight of the monomer and the solvent totaling 100 parts by weight, the monomers are used from 0.1 to 40 parts by weight, preferably, from 2 to 30 parts by weight, and, more preferably, from 5 to 20 parts by weight. Correspondingly, the solvent is present from 60 to 99.9 parts by weight, preferably, from 70 to 98 parts by weight, and, most preferably, from 80 to 95 parts by weight. In addition, 0.05 to 5 weight percent initiator based on the weight of the monomer is added. No surfactant or dispersing aid is required. It is important that the solvent does not swell the polymer, or the polymer will become hard upon drying. Swelling is considered to be evidenced by an increase in volume or by dilation. The amount of swelling that is considered excessive or detrimental depends on the polymer. Detrimental swelling causes the gluing of unit particles together, resulting finally in a clear gel. Suitable solvents are, e.g., isopropyl alcohol or cyclohexane. When isopropyl alcohol is used as the monomer solvent, it was surprisingly found that the isopropyl alcohol must be anhydrous or the water/isopropyl alcohol cosolvent will swell the poly(tetraethylene glycol methacrylate), causing the polymer to be hard upon drying. Preferably the solvent is relatively volatile, having a boiling point of less than 80° C. at one atmosphere and is water-miscible. Removal of the solvent is generally done simply by filtration and evaporation, e.g. by heat and/or vacuum. It was also found that the drying had to be done under anhydrous conditions, or the polymer would become hard upon drying. By anhydrous conditions, it is generally meant that humidity during drying be less than 40% relative humidity. Anhydrous conditions are needed whether the drying takes place at room temperature, elevated temperatures (e.g. 60° C.), or under vacuum. Generally, no solvent extraction is required. The polymer can be washed with a suitable solvent, e.g. the same solvent used in polymerization, before it is dried.

The polymerization is achieved by using one of a variety of free radical initiators which can be, among others, an azo compound, a peroxy dicarbonate, a peroxy ester, or a sulfonyl acid peroxide. Preferably, the free radical initiator will have a 10-hour half life temperature of 75° C. or less, i.e. it is a low to medium temperature initiator. The initiator is employed in an amount from 0.05 to 5 weight percent of the total monomer charge.

Preferably, the initiators of this invention are redox initiators, preferably, secondary or tertiary amines and, more preferably, a tertiary amine and peroxide combination. The ratio between the peroxide and the amine may vary from 0.1 to 5 moles. It is useful to first dissolve the peroxide in a part of the solvent, and separately dissolve the amine in the other part of the solvent, then mix the peroxide part with the monomer solution at room temperature and, subsequently, add the amine part. The charging of the peroxide and amine part can be done at the beginning of the reaction or in portions throughout the reaction period. These amines are generally of the formula $R_2NH$ or R3N wherein R is an alkyl or substituted alkyl, cycloalkyl, or aryl group. Preferably the amine is a tertiary amine.

Other preferred initiators are selected from inorganic initiators such as sodium, potassium, or ammonium persulfates, as the decomposition products of such bisulfates is less harmful than many decomposition products of organic initiators.

The reaction is carried out in the presence of an inert atmosphere. This condition may be achieved by the use of nitrogen, argon, carbon dioxide and the like. Usually, no stirring or very slow stirring (e.g. zero to 300 rotations per minute) is employed.

The reaction is maintained for such time as is required to achieve the desired yield of polymer. This time may be as little as one half hour. However, to approach the theoretical yield, 24 to 48 hours at room temperature, or 4 to 10 hours at elevated temperatures, are required. The monomer solvent is subsequently removed, e.g., by filtration and evaporation, resulting in a dry powder, which can be post adsorbed with a variety of functional active ingredients.

As mentioned, the polymer is in the form of a powder and not hard spheres or beads. The powder is a combined system of particles. The system of particles includes submicron unit particles ranging in size from 0.1 to 0.5 microns in diameter. The particles may range from elliptical to spherical in shape. A typical diameter of a particle is about 0.3 microns. The powder also consists of agglomerates of fused unit particles of sizes in the range of about ten to eighty microns in average diameter, and aggregates of clusters of fused agglomerates of sizes in the range of about two hundred to about eight hundred microns in average diameter. When mild pressure is applied to the powder, the aggregates and agglomerates are easily crushed into the small particles. Thus, the powder can be described as being "soft" in that the aggregate and agglomerate structure easily changes upon pressure and they cannot be easily felt when rubbed on the skin, between teeth, or on sensitive human mucous membranes. Powders disappear when rubbed upon a surface. This phenomenon is believed to be due to the fact that large aggregates of the material scatter light rendering the appearance of a white particulate; however, upon rubbing, these large aggregates decrease in size approaching the range of visible light and, hence, seem to disappear. The materials do not swell in common solvents and are capable of physically adsorbing active ingredients by filling of interstitial voids by capillary action. The powders are often capable of adsorbing from sixty to eighty percent of a liquid and yet remain free flowing. The polymer powder of this invention can adsorb up to about 80 weight percent of hydrophilic liquids or up to 70–80 weight percent hydrophobic liquids. Due to these properties, the polymers are very suitable for cleaning of contact lenses, especially soft lenses, removing proteins and lipids from the surface via adsorption. The unit particles themselves do not have any significant porosity, usually less than 2%.

The size and adsorptive properties of these polymeric particles can be influenced by the concentration of the monomer and the stirring rate. As a matter of rule, lower concentrations of the monomer and slower stirring result in higher adsorptivity.

The powder used in this invention exhibits adsorbent and mildly abrasive properties which make it useful as a cleaning agent. The powder has great cleaning ability when employed as an abrasive in cleaners without the scratching, grinding, gouging, etc., which is objectionable during cleaning optical surfaces and other fine surfaces. The nature of the powder permits it to adsorb surfactants and other cleaners so as to permit controlled application to the desired surface. The powder is useful in contact lens cleaners, facial scrubs, heavy-duty hand cleaners, automotive or household cleaners, vinyl or leather cleaners, tile and sanitary ware cleaners and the like.

For further teaching of aqueous cleaning formulations, U.S. Pat. No. 4,655,957 is hereby incorporated by reference. The poly(tetraethylene glycol methacrylate) powder is especially useful in removing proteins and lipids from the surface of contact lenses without scratching the lens surface. The cleansing dispersion is simply used by applying the dispersion to the dirty surface, and the cleaning effects are further enhanced by moving the cleaning dispersion over the surface, e.g. by rubbing. Then the surface is generally rinsed or wiped clean. For contact lens cleaning, the wearer of the contact lenses removes the lenses from the eyes, shakes the dispersion to insure homogeneity, and applies a small amount of the dispersion to the lenses. The lenses are then rubber with the dispersion and thereafter rinsed with preserved saline solution.

The following examples are presented for purposes of illustration and should not be construed as limiting the invention which is delineated in the claims.

The following test procedures were used to determine various properties of the polymer prepared in Example 1.

Procedure for Determining Total Adsorption Capacity (TAC)

A glass column, having a height of 110 mm and a diameter of 5 mm, made from a disposable capillary pipet and being sealed by glass wool at the bottom, was filled with approximately 0.05 grams of dry powder polymeric particles as prepared in Example 1. The top of the column was then sealed with glass wool. The bottom part of the column (conically-shaped) was connected to a "U"-shaped glass tubing, containing the liquid tested, and the column was immersed into a constant temperature bath. The liquid was allowed to enter the column slowly by gravity from the bottom to the top of the column, and left in the column for 5 minutes. The column was then disconnected from the tube and the liquid was sucked out of the column using a vacuum. The total adsorption capacity was calculated from the weight difference of the powder with the liquid and the dry powder according to the equation:

$$TAC\,(\%) = \frac{(\text{wt. powder + liquid}) - (\text{initial wt. powder})}{(\text{wt. powder + liquid})} \times 100\%$$

Blind experiment for adsorption on the glass wool and walls of the column was deducted. The determination was done at 25° C. for all liquids except glycerine, which was done at 90° C.

Procedure for Determining Free Flowing Capacity (FF)

Free Flowing Capacity is the maximum percent liquid added while still maintaining the powder in the free flowing state. The free flowing adsorption capacity was determined by addition of incremental amount of liquid to a known amounts of powder, using gentle mixing, until the powder was no longer free flowing. All determinations were completed at 25° C. except when glycerine was used, which determinations were carried out at 90° C. The capacity (FF) as shown in Table I was determined by the following calculation:

$$FF\,(\%) = \frac{(\text{wt. powder + liquid}) - (\text{initial wt. powder})}{(\text{wt. powder + liquid})} \times 100\%$$

Procedure for Determining Dispersibility

A sample of the powder with an excess of the liquid are shaken and observed for miscibility.

Procedure for Determining Apparent Density

A graduated cylinder was filled with a known weight of the powder and the corresponding volume was determined after gently tapping the sides of the cylinder.

EXAMPLES

Example 1

In a three-necked resin reaction flask, 20 grams of tetraethylene glycol dimethacrylate were dissolved, at room temperature, in 80 grams of isopropyl alcohol containing 0.4 grams of dibenzoyl peroxide. The solution was purged with nitrogen for 10 minutes, and a slow nitrogen stream was kept during the entire reaction time. Under stirring, 0.4 grams of p-dimethylamino benzoic acid, 2-ethylhexyl ester were added. After five minutes, the stirring was stopped. A slightly exothermic polymerization occurred, the temperature rising to 50° to 60° C., and, then, the polymer began to precipitate. After cessation of the exotherm, the system was heated to 60° C. for 6 hours, and the contents of the flask solidified. After cooling to room temperature, the powder was washed with isopropyl alcohol and dried at room temperature or in vacuo, yielding 19.2 grams or 96% of theoretical.

Properties of the poly(tetraethylene glycol methacrylate) powder were determined and are given as given in Table 1.

TABLE I

| Composition | Solvent | Adsorption Capacity & Free Flowing Capacity (%) | | | | | | | | | | Dispersibility in Solvent[a] | | | | Apparent Density g/cm³ |
|---|---|---|---|---|---|---|---|---|---|---|---|---|---|---|---|---|
| | | Water | | Min. Oil | | Glycerine | | W171[b] | | D.C.344[c] | | | | | | |
| | | TAC[e] | FF[f] | TAC | FF | TAC | FF | TAC | FF | TAC | FF | Water | Triton X-100[d] 1:100 In Water | Mineral Oil | Silicone Oil D.C.344[c] | |
| Tetra-Ethylene Glycol Dimethacrylate | IPA[g] | 78.3 | 73.7 | 73.7 | 64.3 | 83.9 | 72.2 | 83.9 | 73.7 | 79.2 | 71.4 | + | + | ± | + | 0.1534 |

[a] + = complete
± = partial
− = sedimentation observed
[b] = Wickenol ® 171 (2-ethylhexyl oxystearate) available from Wicken Products, Inc. of Huguenot, New York.
[c] = Dow Corning ® 344 (a polydimethylcyclosiloxane fluid having a viscosity of 2.5 cst at 25° C.) available from Dow Corning Corporation, Midland, Michigan.
[d] = Triton ® X100 (oxtylphenoxy ethoxy ethanol) available from Rohm & Haas Company, Inc., Philadelphia, Pennsylvania
[e] = Total Adsorptive Capacity (%)
[f] = Free Flowing Capacity (%)
[g] = isopropyl alcohol

Example 2

Properties of poly(tetraethylene glycol methacrylate) powder compared to that of the preferred particulate in U.S. Pat. No. 4,655,957 are given below in Table II. The polymer powder of tetraethylene glycol dimethacrylate (Polymer A) was prepared as described in Example 1.

The preferred particulate in U.S. Pat. No. 4,655,957 is poly(hydroxyethyl methacrylate) (see column 2, lines 47–49). The poly(hydroxyethyl methacrylate) (Polymer B) was prepared by dissolving 23.38 grams of ethylene glycol dimethacrylate, 23.39 grams of methylmethacrylate, 93.38 grams of 2-hydroxyethyl methacrylate, and 2.8 grams dibenzoyl peroxide in 560 mls of xylene at room temperature in a round-bottom flask equipped with a reflux condenser. The solution was purged with nitrogen for 10 minutes and, subsequently, 2.8 grams of p-dimethylamino benzoic acid 2-ethylhexyl ester were added under stirring. The reactor was closed and positive nitrogen pressure applied. The temperature was raised to 50°–55° C. where the precipitation of the polymer commenced. Then the system was heated gradually to 60°–65° C. where the content of the vessel solidified. The polymerization was finished by heating to 75°–80° C. for 4 hours. The polymer was filtered, and the remaining polymer was washed with ethyl alcohol and dried at ambient temperature and pressure. The yield was 131.9 grams (99.2% of theoretical).

TABLE II

| Polymer | Free flowing capacity with water (%) | Miscibility in water |
|---|---|---|
| A | 78.3 | + |
| B | 50.0 | +/− |

Polymer A powder was miscible in water without the use of surfactants and had good water adsorptivity, whereas Polymer B powder was only somewhat miscible in water and did not have as high a water adsorptivity as Polymer A powder. These properties of Polymer A powder make the formulation of aqueous dispersions easier, requiring less additives, such as surfactants and stabilizing agents, in the formulations. This is not only beneficial in terms of cost reduction and ease in processing, but it is also beneficial to reduce additives, such as surfactants, in cleansers which come in contact with the body to reduce potential irritation. A reduction in potential irritation to the eye caused by residual surfactant, etc. on a contact is especially beneficial to the user. The higher water compatibility of Polymer A is also advantageous in cleaning dispersions for hydrophilic surfaces, such as soft contact lens, in that it is compatible with the surface and therefore spreads on the surface easily.

Other advantages of Polymer A powder over Polymer B powder are concerned with the method of making the polymer powders. Polymer A powder can be made in isopropyl alcohol, which is easily removed by drying. Polymer B, however, cannot be made in isopropyl alcohol, generally requiring a hydrophobic solvent, such as xylene. Xylene is difficult to remove from Polymer B powder and is more quickly removed if solvent extracted with ethyl ether or hexane or removed by steam distillation followed by alcohol washing, thus requiring additional processing steps and use of more solvent.

Example 3

A polymer powder/water mixture is prepared by mixing 5 parts by weight of the polymer powder prepared in Example 1 with 95 parts by weight water. A small amount of the polymer/water mixture is applied to a dirty contact lens and rubbed gently. The polymer/water mixture is then rinsed thoroughly from the contact lens with sterile saline solution, and the contact lens is then clean and ready for wear.

These and other variations of the present invention may be made which fall within the scope of the appended claims even though such variations were not specifically discussed above.

That which is claimed is:

1. An aqueous cleaning dispersion comprising a homogeneous mixture of:

(a) water and (b) a liquid-adsorbable homopolymer of tetraethylene glycol dimethacrylate in powder form.

2. A dispersion as claimed in claim 1 wherein said tetraethylene glycol dimethacrylate homopolymer is employed in an amount ranging from 0.001 to 25 weight percent of said dispersion.

3. A dispersion as claimed in claim 1 further comprising a surfactant.

4. A dispersion as claimed in claim 3 wherein said surfactant is employed from 0.1 to 10 weight percent of said dispersion.

5. A dispersion as claimed in claim 1 wherein said poly(tetraethylene glycol methacrylate) powder is prepared by the steps comprising:

(a) homogeneously mixing a solution comprising from 0.1 to 40 parts by weight of tetraethylene glycol dimethacrylate, from 60 to 99.9 parts by weight of a solvent, wherein the total weight of said tetraethylene glycol dimethacrylate and said solvent is 100 parts, and 0.05 to 5 weight percent initiator based on the weight of said tetraethylene glycol dimethacrylate, and (b) polymerizing said tetraethylene glycol dimethacrylate to form a polymer, wherein said solvent is a solvent for tetraethylene glycol dimethacrylate and a non-swelling non-solvent for said polymer.

6. A dispersion as claimed in claim 5 wherein said method of preparing said poly(tetraethylene glycol methacrylate) powder further comprises the step of:

(c) removing said solvent from said polymer.

7. A dispersion as claimed in claim 6 wherein said monomer solvent is anhydrous isopropyl alcohol.

8. A dispersion as claimed in claim 7 wherein said isopropyl alcohol is removed by drying in anhydrous conditions.

9. A method for cleaning contact lenses comprising the steps of:

(a) applying the dispersion claimed in claim 1 to a contact lens, (b) rubbing the lens with said dispersion, and, (c) thereafter, rinsing the lens.

10. A method for cleaning contact lenses comprising the steps of:

(a) applying the dispersion claimed in claim 2 to a contact lens, (b) rubbing the lens with said dispersion, and, (c) thereafter, rinsing the lens.

11. A method for cleaning contact lenses comprising the steps of:

(a) applying the dispersion claimed in claim 3 to a contact lens, (b) rubbing the lens with said dispersion, and, (c) thereafter, rinsing the lens.

12. A method for cleaning contact lenses comprising the steps of:

(a) applying the dispersion claimed in claim 4 to a contact lens, (b) rubbing the lens with said dispersion, and, (c) thereafter, rinsing the lens.

13. A method for cleaning contact lenses comprising the steps of:

(a) applying the dispersion claimed in claim 5 to a contact lens, (b) rubbing the lens with said dispersion, and, (c) thereafter, rinsing the lens.

14. A method for cleaning contact lenses comprising the steps of:

(a) applying the dispersion claimed in claim 6 to a contact lens, (b) rubbing the lens with said dispersion, and, (c) thereafter, rinsing the lens.

15. A method for cleaning contact lenses comprising the steps of:

(a) applying the dispersion claimed in claim 7 to a contact lens, (b) rubbing the lens with said dispersion, and, (c) thereafter, rinsing the lens.

16. A method for cleaning contact lenses comprising the steps of:

(a) applying the dispersion claimed in claim 8 to a contact lens, (b) rubbing the lens with said dispersion, and, (c) thereafter, rinsing the lens.

* * * * *